US006933891B2

(12) United States Patent
Lange

(10) Patent No.: US 6,933,891 B2
(45) Date of Patent: Aug. 23, 2005

(54) HIGH-EFFICIENCY TRANSPARENT MICROWAVE ANTENNAS

(75) Inventor: Mark Lange, Camarillo, CA (US)

(73) Assignee: Calamp Corp., Oxnard, CA (US)

( * ) Notice: Subject to any disclaimer, the term of this patent is extended or adjusted under 35 U.S.C. 154(b) by 36 days.

(21) Appl. No.: 10/198,773

(22) Filed: Jul. 18, 2002

(65) Prior Publication Data

US 2003/0142018 A1 Jul. 31, 2003

Related U.S. Application Data

(60) Provisional application No. 60/352,738, filed on Jan. 29, 2002.

(51) Int. Cl.[7] ..... H01Q 1/32
(52) U.S. Cl. ..... 343/700 MS; 343/713
(58) Field of Search ..... 343/713, 700 MS, 343/700, 711, 715, 841, 897, 756, 909, 771, 826

(56) References Cited

U.S. PATENT DOCUMENTS 5,589,839 A * 12/1996 Lindenmeier et al. ..... 343/713
5,670,966 A 9/1997 Dishart et al.
5,999,136 A 12/1999 Winter et al.
6,107,964 A * 8/2000 Hirabe ..... 343/700 MS
6,480,170 B1 * 11/2002 Langley et al. ..... 343/826

OTHER PUBLICATIONS

Johnson, Richard, *Antenna Engineering Handbook*, third edition, 1993, McGraw–Hill, Inc., New York,, pp. 46–3 to 46–10.

Frost, Pam, "New Radio Antennas May Cool Car Interiors", Ohio State University press release, Oct. 28, 1998.

Lee, Richard, etl al., "Optically Transparent Patch Antennas", John H. Glenn Research Center, Cleveland, OH, press release.

* cited by examiner

*Primary Examiner*—James Clinger
(74) *Attorney, Agent, or Firm*—Koppel, Jacobs, Patrick & Heybl

(57) ABSTRACT

The present invention provides for inexpensive transparent microwave antennas with high efficiency. Conductors for the antennas are formed from metallic meshes with a net transparency greater than 70% and supported by a clear substrate. The associated antenna gain efficiencies are greater than 50%.

28 Claims, 7 Drawing Sheets

HIGH-EFFICIENCY TRANSPARENT MICROWAVE ANTENNAS

CROSS REFERENCES TO RELATED APPLICATIONS

This application claims the benefit of U.S. Provisional Application, Serial No. 60/352,738 filed Jan. 29, 2002.

BACKGROUND OF THE INVENTION

1. Field of the Invention

The present invention relates generally to antennas.

2. Description of the Related Art

The high cost of professional outdoor antenna installations for broadband wireless access (transmission of voice, data and video) has created a demand for lowermost, user-installable indoor antennas. To meet this demand, optically-transparent conductive films (e.g., silver or indium tin oxide) have been proposed. Although the transparency of such films may be on the order of 70% to 80%, their surface resistance is typically on the order of 4 to 8 ohms per square or higher. This conductivity level generally produces microwave antennas whose efficiency (e.g., on the order of 10%) is less than desirable.

SUMMARY OF THE INVENTION

The present invention is directed to inexpensive microwave antenna structures that have high-efficiency and are substantially-transparent. These structures are especially suited for use as indoor antennas (e.g., as installed by subscribers of wireless systems).

DETAILED DESCRIPTION OF THE INVENTION

Figure 1:
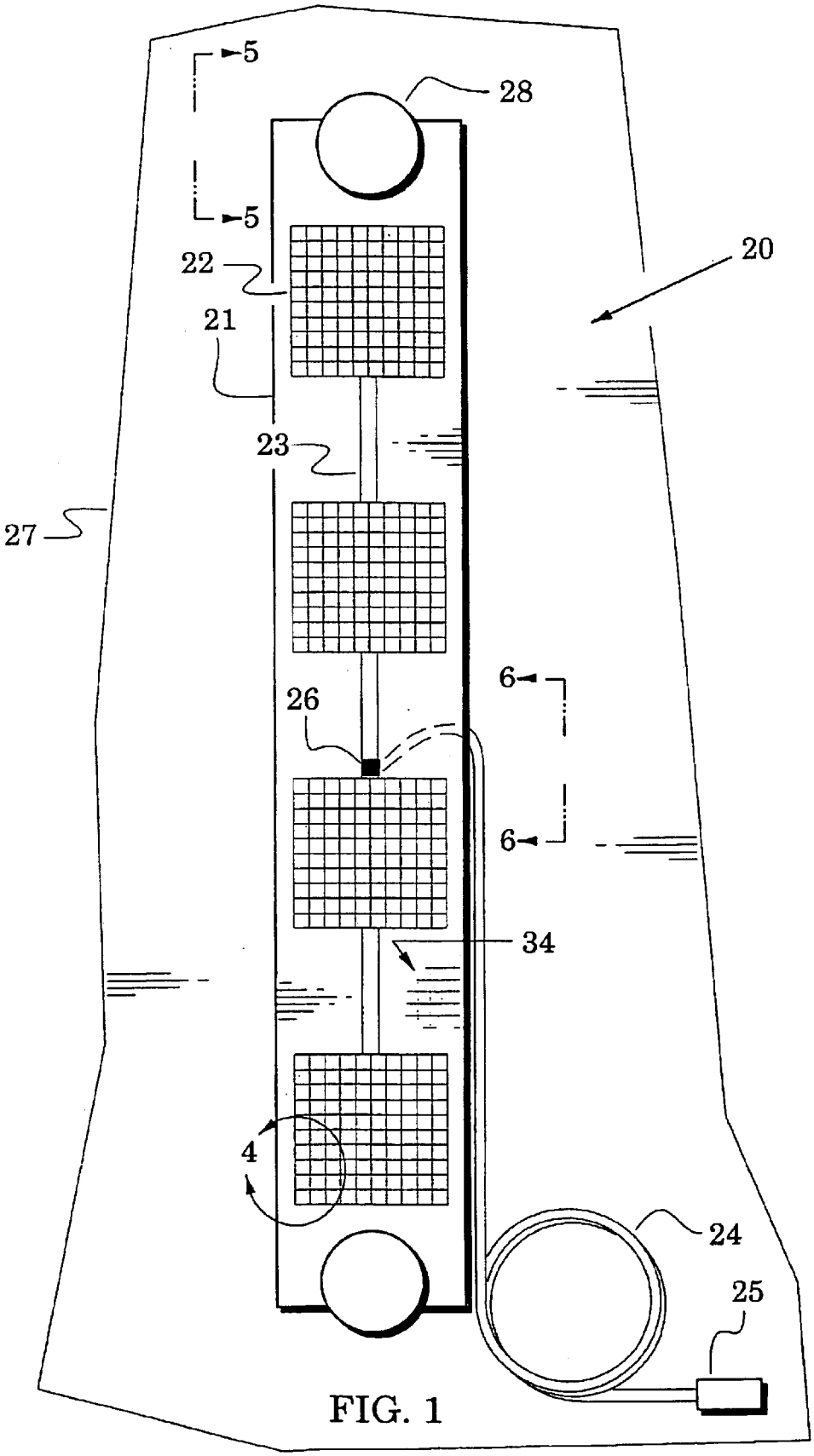
FIG. 1 is a front view of a vertically-polarized antenna embodiment of the present invention showing a serial feed.

Transparent antenna embodiments of the present invention are generally formed with a substantially-transparent substrate made from any transparent dielectric material. Exemplary dielectric materials (and their relative dielectric constants) include glass (5.5), polystyrene (2.6), polycarbonate (3.0), air (1), polyester (3.1) and acrylic (2.8). Although all of these materials can be obtained in optical quality grades and are highly transparent, acrylic is especially attractive because of its low cost, inherent ultra violet (UV) stability and manufacturability.

Substrates can also be formed as combinations of dielectric materials (e.g., a frame of acrylic with air between frame elements. Substrates of the invention can be formed by various conventional methods (e.g., injection molding or extrusion) and then machined to shape. A typical substrate thickness ranges from 0.02 to 0.1 wavelengths in the dielectric material.

Upper and lower surfaces of substrates of the invention are partially or completely covered with a conductive mesh which is substantially transparent at optical wavelengths but substantially opaque at greater transmitting or receiving wavelengths (e.g., microwave wavelengths). For one microstrip patch antenna embodiment, the lower (back) surface of the substrate is preferably completely covered and the upper (front) surface is covered with a pattern of patches and feed lines. Exemplary conductor materials for the mesh are highly conductive metals such as aluminum, copper, gold, silver, tin and nickel and these can be used in solid or plated forms. Aluminum and tin-plated copper are especially attractive for their low cost, high conductivity and silver color.

Conductor thickness is selected in accordance with antenna operational frequency. In antenna embodiments that operate in the 2.4–2.7 GHz range, a copper thickness in the range of 0.5–1 ounce is generally sufficient. Higher-frequency embodiments may use thinner layers and lower-frequency ranges may use thicker layers. Metal conductors can be deposited directly on to the transparent substrate or deposited (e.g., by plating or rolling) onto a thin film of plastic (e.g., polyester). A polyester embodiment makes use of the large volumes of metal-on-polyester films currently available at low cost.

The metal conductor can then be formed (e.g., etched) into a mesh having dimensions which produce a substantially transparent film, e.g., between 70% and 90% transparency. The mesh has a total area, is formed of conductive members which define open spaces between said conductive members that sum to a open-spaces area, and has a transparency of at least 70% wherein transparency is defamed as a ratio of open-spaces area to total area. In effect, this yields an average transparency of the material. The color (e.g., silver) of the remaining metal can be selected to further reduce its visibility.

In one embodiment, the mesh forms a grid pattern in which mesh members are orthogonally arranged. In an exemplary fabrication method, the metal conductor is etched to produce transparent squares 0.114 inches on a side with metal lines 0.014 inches wide surrounding the transparent squares. This computes to a transparency of 79% using the above definition. An alternative embodiment can form the metal conductors with a mesh of thin round wires.

The metal conductor can be attached to the substrate in various manners, e.g., with an adhesive that is preferably optically clear. For example, one embodiment uses an acrylic-based pressure-sensitive adhesive (e.g., from 3M Corporation of St. Paul, Minn.).

The transparent antenna is preferably connected to a thin coaxial cable (e.g., an RG-316 type coax approximately 16 feet long) with a connector on the end opposite the antenna. The connection to the antenna can be take on various forms, e.g., the cable can be directly soldered to small pads in the upper and lower conductors or capacitively coupled, i.e., not directly soldered. The latter embodiment helps to evenly distribute the currents onto the conductive mesh. This is especially important when the conductor forms a ground plane that is connected, for example, to the outer shield of the coaxial cable.

Capacitive coupling may be realized by soldering a small disk or quarter wavelength stub on to the end of the center conductor of the coaxial cable and spacing it from the conductive mesh of the antenna with pressure-sensitive adhesive and polyester film or with a small amount of substrate material. For the frequency range discussed above, an exemplary dielectric thickness is in the range of 0.001 and 0.010 inches.

Antenna embodiments may comprise single or multiple meshed patches with meshed feed lines in any conventional microstrip geometry (e.g., square, rectangular or circular patches with serial or parallel feed lines). Antenna embodiments can be linear or planar arrays with linear or circular polarizations. For example, one embodiment is a 4 element linear array with a serial feed.

Exemplary antenna installations can be temporary (e.g., attached to a window with clear silicone suction cups) or permanent (e.g., attached with pressure-sensitive adhesive).

A transparent microwave antenna embodiment 20 is shown in FIG. 1. As oriented in the figure, the antenna is a vertically-polarized microstrip patch array with a serial feed and a transparency of ~79%. In particular, the antenna consists of an optically transparent substrate 21 with a multiplicity of wire mesh patches 22 and associated feed lines 23. Although the feed lines may also be defined by a conductive mesh, transparency is further enhanced by forming them with one or more elongate conductors as shown in the embodiment of FIG. 1. A coaxial cable 24 with a connector 25 on a far end is coupled to the antenna at an appropriate point which has a small solid region 26 in the conductive mesh. In FIG. 1, the assembly is attached to a window 27 with at least one substantially-transparent suction cup 28.

Figure 2:
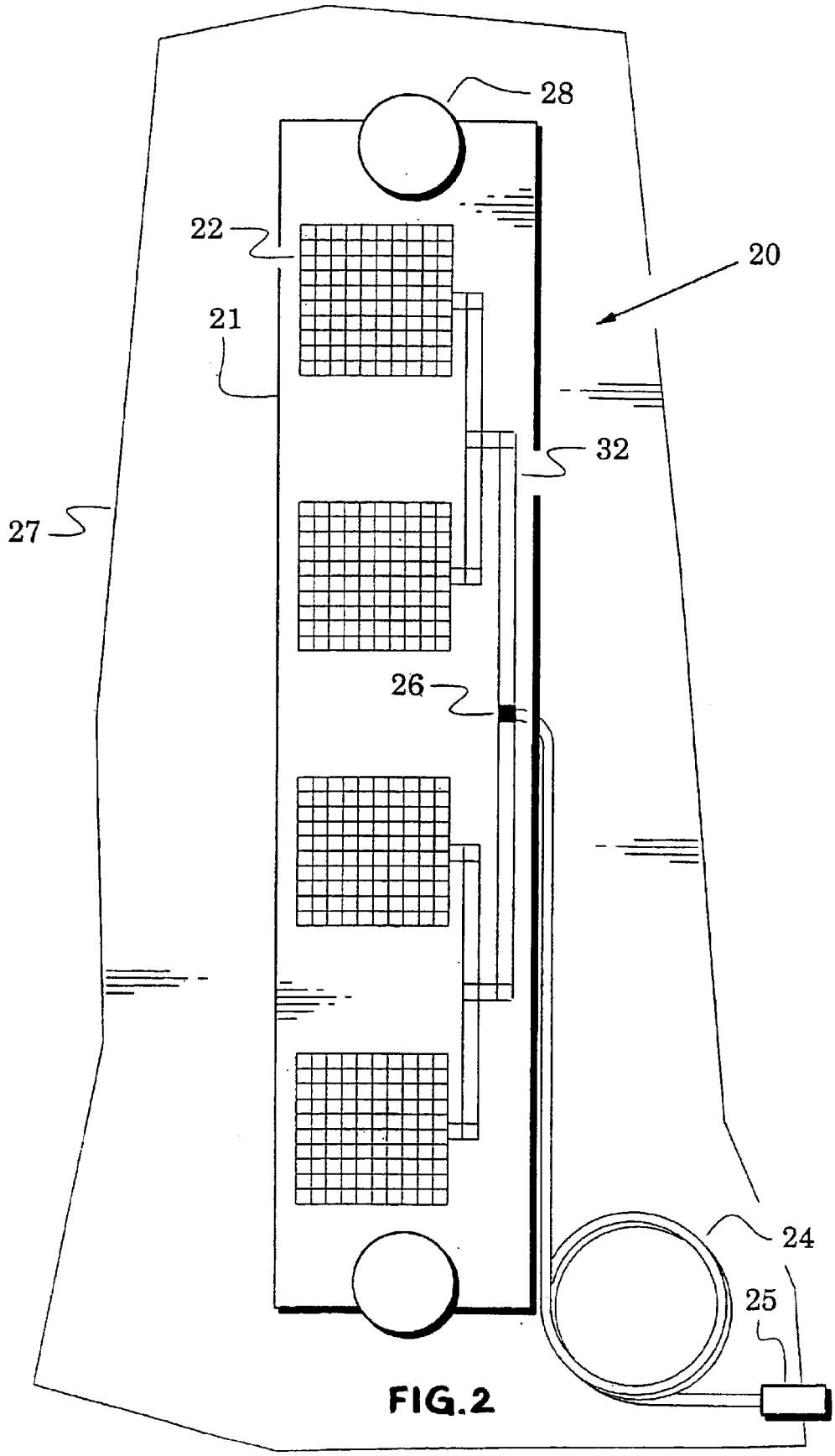
FIG. 2 is another antenna embodiment that shows the antenna of FIG. 1 modified to have a parallel feed.

FIG. 2 illustrates an antenna 30 which has some elements similar to FIG. 1 with like elements indicated by like reference numbers. In contrast, however, the antenna 30 has a feed line 32 that couples in parallel to each side of the mesh patches 22 which causes the antenna to be a horizontally-polarized antenna. The coaxial cable 24 couples to the parallel feed line 32. Similar to the feed lines 23 of FIG. 1, the feed line 32 may be defined by a conductive mesh or formed with elongate conductors as shown in FIG. 2.

Figure 3:
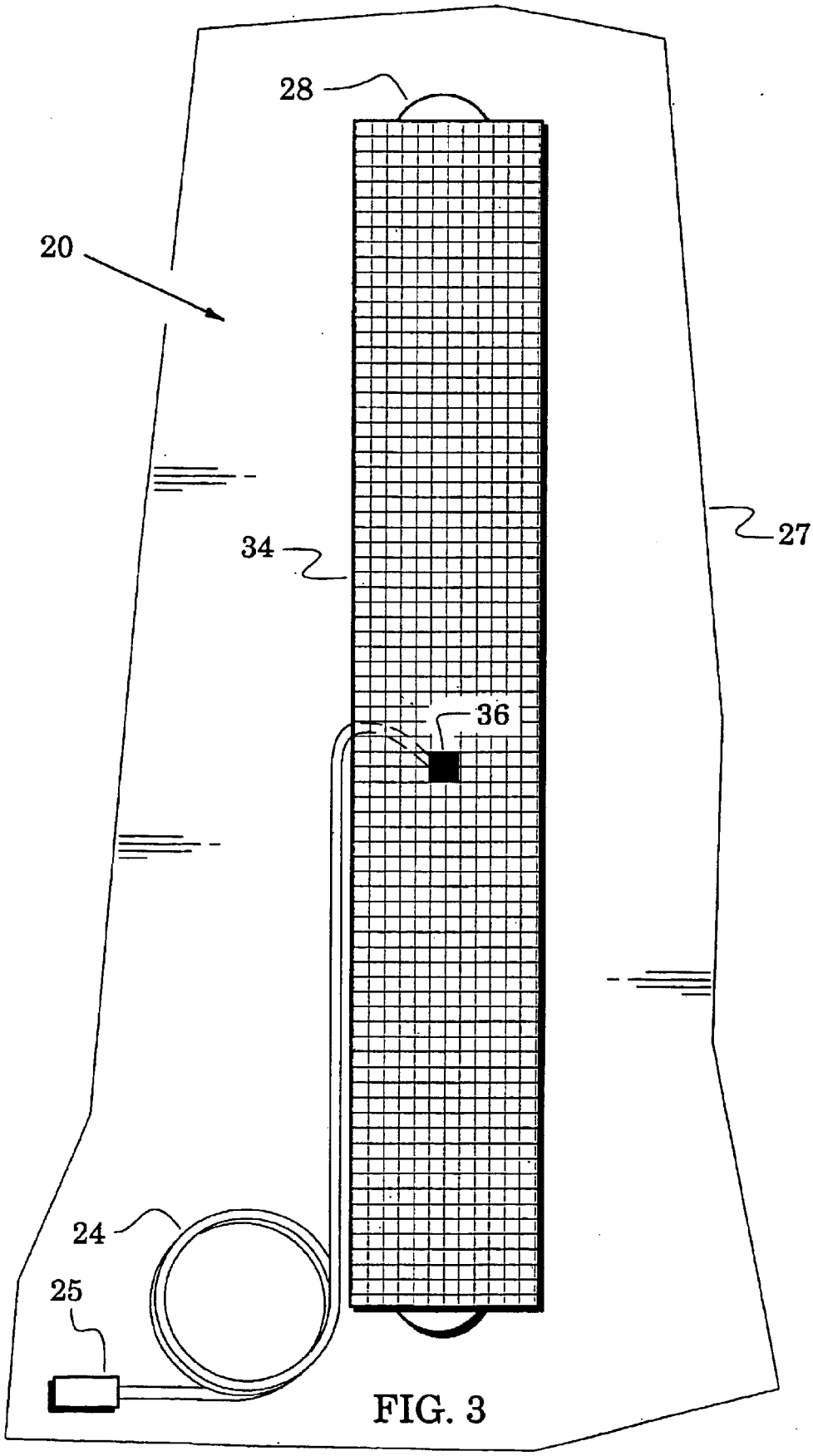
FIG. 3 is a back view of the antenna of FIG. 1.

FIG. 3 shows the lower (back) structure of the antenna of FIG. 1 in which a microstrip antenna configuration has most or all of the transparent substrate (21 in FIG. 2) covered with a mesh conductor 34 with a transparency of approximately 79%. The mesh conductor 34 would be visible in the front view of FIG. 1 but because it would obscure other details in this view, only a partial segment is shown at the lower left (of FIG. 1).

The outer shield of the coaxial cable is attached to the conductive mesh with a small solid conductor region 36 defined in the mesh to help facilitate the even distribution of currents into the mesh (the coupling point in FIG. 1 has a similar small solid region 26 for attachment of the cable's center conductor). If aesthetically desired, the feed points can be covered to hide the feed connections (e.g., with double-wall heat shrink tubing or other aesthetic material). FIG. 3 also shows the connector 25 and the substantially-transparent suction cups 28 of FIG. 1.

Figure 4:
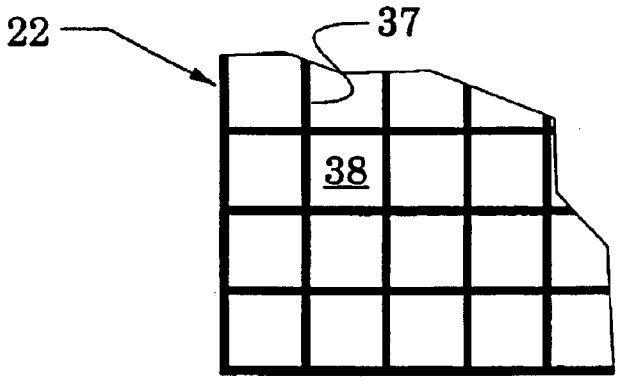
FIG. 4 is an enlarged view of conductive mesh within the curved line 4 of FIG. 1.

FIG. 4 is an enlarged portion of the conductive mesh 22 within the curved line 4 in FIG. 1. The mesh 22 is formed with conductive members (e.g., flat ribbons or round wires) 37. It is noted that transparency can be defined by observing that the conductive mesh 22 has a total area and is formed of conductive members 37 which define open spaces 38 between them that sum to a open-spaces area. Transparency, then, is a ratio of open-spaces area to total area. Preferably, the transparency of the conductive mesh is at least 70% to enhance the usefulness of antennas of the invention.

Figure 5A:
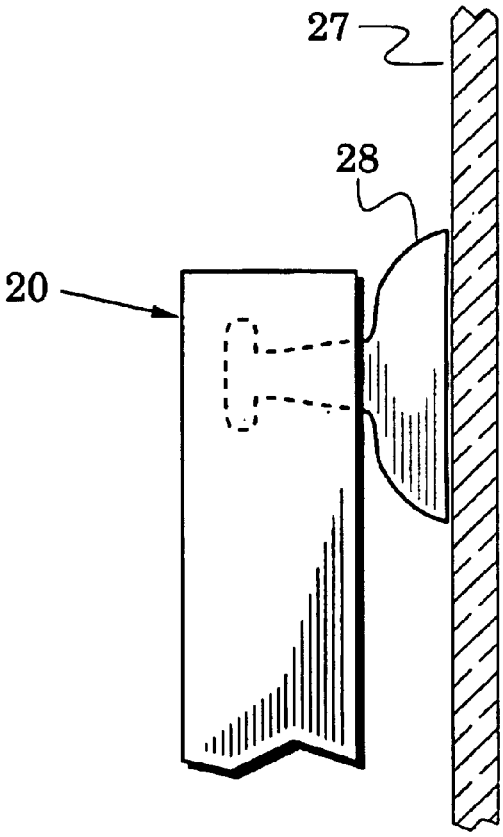
FIGS. 5A and 5B are enlarged views along the plane 5—5 of FIG. 1 that show different mounting structure embodiments.
Figure 5B:
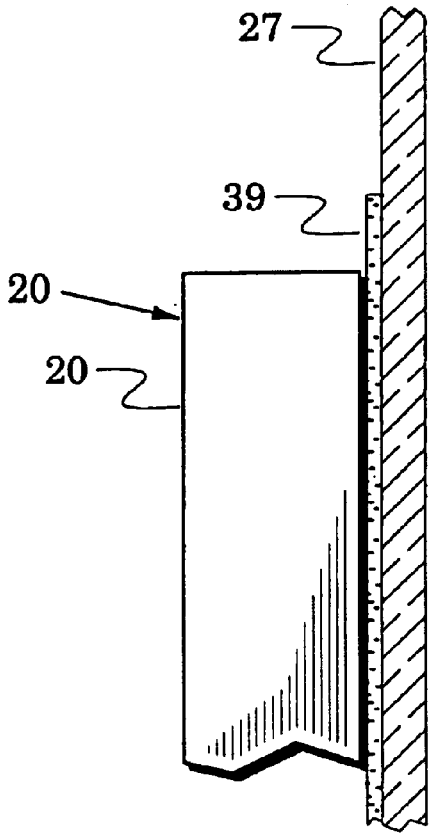

FIG. 5A is an enlarged view along the plane 4—4 of FIG. 1 which illustrates attachment of the antenna 20 to the window 27 with the suction cups 28 (which can be coupled to the substrate 21 in any conventional manner). FIG. 5B illustrates another attachment embodiment in which a pressure-sensitive adhesive layer 39 (or other suitable adhesive) couples the antenna 20 to the window 27.

Figure 6A:
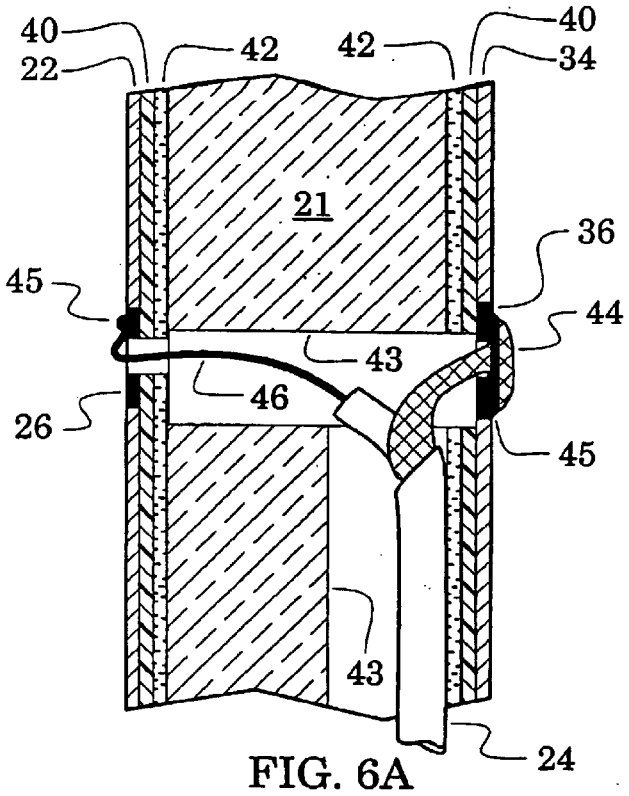
FIGS. 6A and 6B are enlarged sectional views along the plane 6—6 of FIG. 1 that respectively show directly-coupled and capacitively-coupled cables.

A directly-coupled feed structure is shown in the enlarged view of FIG. 6A. Also shown are the patch mesh 22 and the ground plane mesh 34 which are both carried on thin plastic (e.g., polyester) films 40 and mounted to the substrate 21 with optically-clear adhesives 42. The cable 24 is arranged within a cavity 43 that is formed (e.g., machined or molded) in the substrate. The cable's shield 44 is attached (e.g., with solder 45) to the solid conductor region 36 and the cable's center conductor 46 similarly attached to the solid conductor region 26.

Figure 6B:
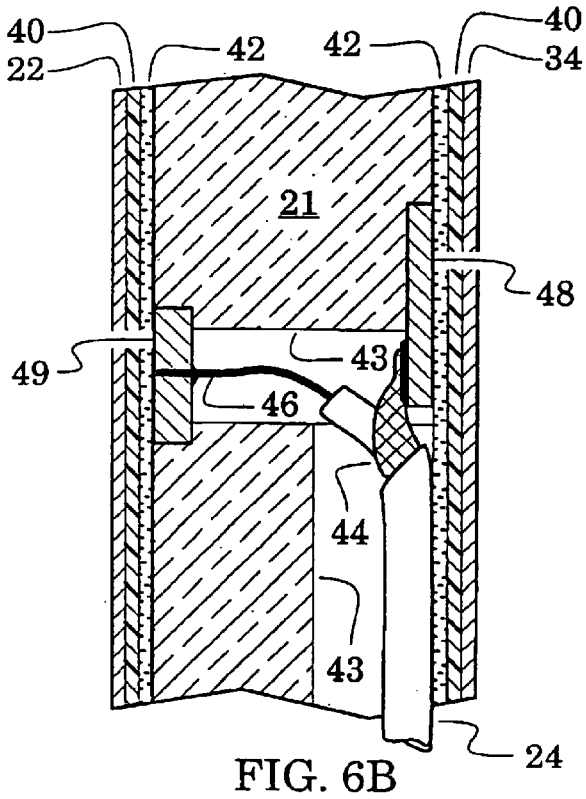

A capacitively-coupled feed structure is shown in the enlarged view of FIG. 6B with like elements of FIG. 6A indicated by like reference numbers. Capacitive coupling structures are a metallic quarter wavelength stub 48 and a small metallic disk 49 which are respectively spaced from the conductive meshes 34 and 22 by the film 40 and adhesive 42. The cable's shield 44 is soldered to the stub 48 and the cable's center conductor 46 similarly attached to the disk 49.

Figure 7A:
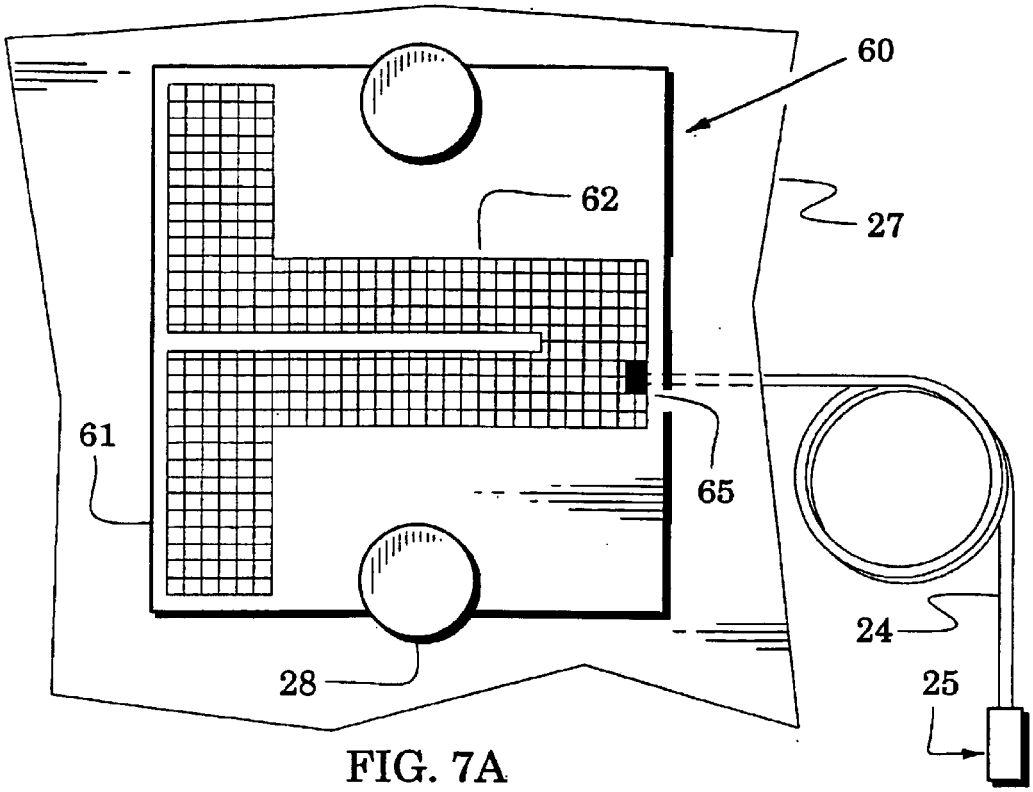
FIG. 7 is a front view of another antenna embodiment of the present invention.
Figure 7B:
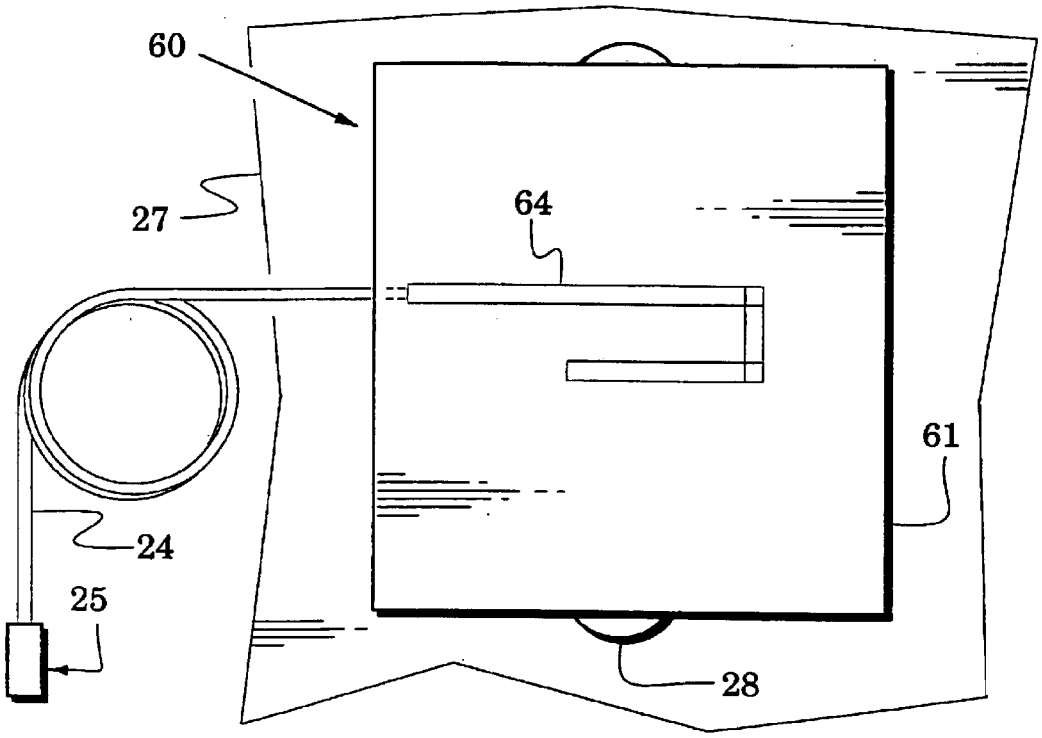

The teachings of the invention can be used to form various different substantially-transparent antenna embodiments. FIGS. 7A and 7B, for example, illustrate an antenna embodiment 60 in which a conductive mesh forms a dipole 62 on one side of a transparent dielectric substrate 63 and another conductive mesh forms a feed line 64 on another side of the substrate. A small solid conductor region 65 is defined by the dipole and the shield of a cable 24 is coupled (e.g., soldered) to this region. The center conductor of the cable 24 is coupled to the feed line 64 and the cable terminates in a connector 25. The antenna 60 is attached to a window 27 with suction cups 28.

Figure 8B:
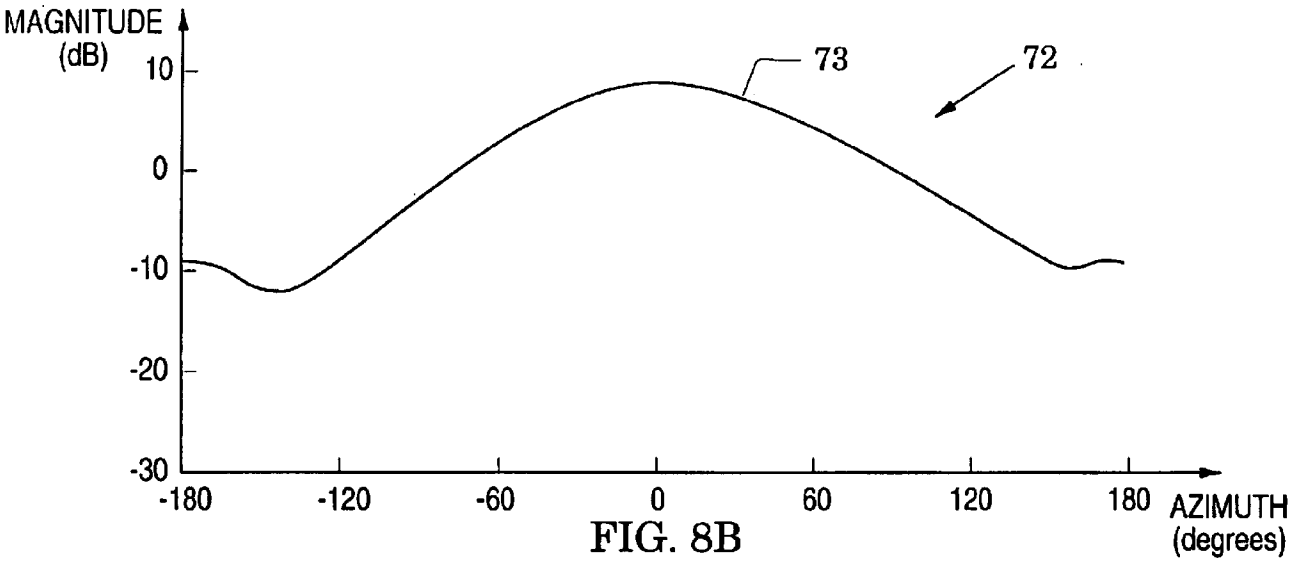
FIGS. 8A and 8B are graphs that illustrate measured elevation and azimuth gain patterns for an antenna embodiment of the present invention.
Figure 8A:
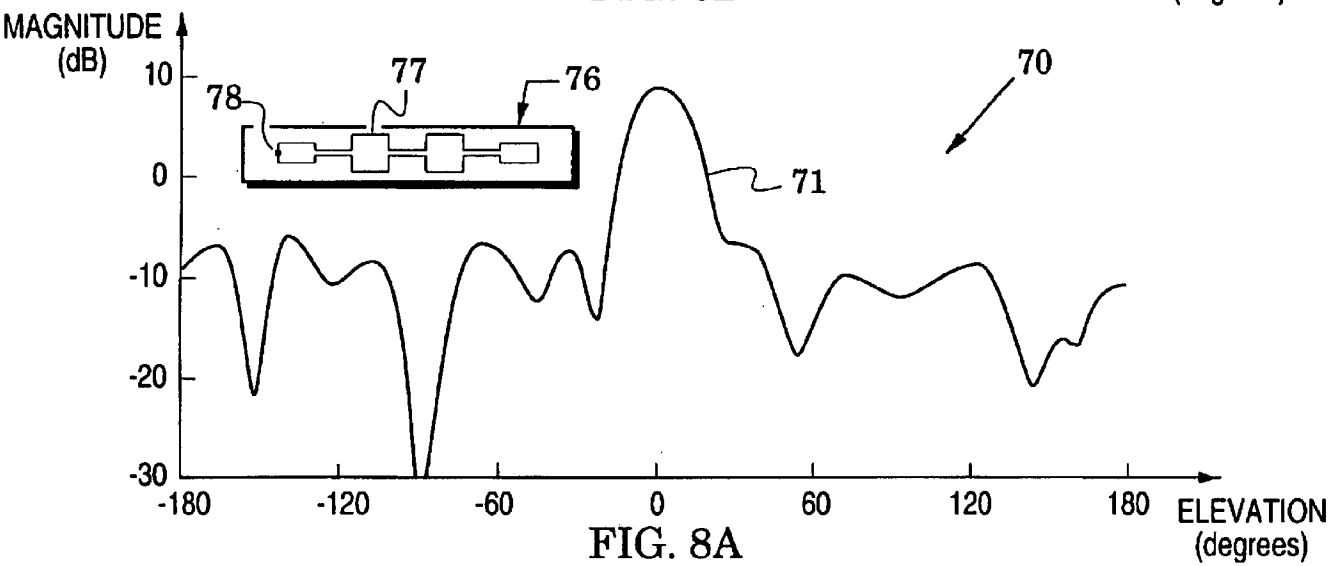

A vertically-polarized test antenna was formed in accordance with the teachings of the invention and tested to determine the elevation and azimuth gain patterns shown in FIGS. 8A and 8B. In particular, the graph 70 of FIG. 8A illustrates a plot 72 of the elevation pattern and graph 72 of FIG. 8B illustrates a plot 73 of the azimuth pattern.

A sketch in FIG. 8A shows that the test antenna 76 had 4 patches (on a 2 by 12 inch acrylic substrate with a thickness of 0.25 inches) that were coupled by a vertical feed and the antenna was driven (with a 2.5 GHz signal) through a 12 inch coaxial cable that was coupled to the antenna at a point 78. This feed point forms an antenna embodiment that can be vertically scanned by varying the drive frequency. Other feed points may be selected in other antenna embodiments (e.g., the antenna of FIG. 1) to obtain a fixed predetermined beam elevation.

The elevation plot 71 of FIG. 8A indicates a main beam that has a gain of 8.37 dB with a beam width of 23.94 degrees and side lobes that are less than or equal to −14.94 dB. The azimuth plot 73 of FIG. 8B indicates a main beam that has a beam width of 96.08 degrees. The test antenna thus exhibited high efficiency (>50%) with gain that was significantly greater (e.g., by 8–10 db) than would be realized with low-efficiency (−10%) transparent antennas (e.g., ones formed with conductive films).

In an exemplary use of antennas of the invention, subscribers to a wireless system can exchange microwave signals with a system base station. In this use, a substantially-transparent antenna is preferably positioned in a subscriber's window (and preferably remote from a modem). The attenuation from the walls enclosing the window will have minimal impact on signals and the high transparency of the invention significantly reduces the obtrusiveness of window-mounted antennas. Embodiments of the invention have been described in which antenna elements are formed with a conductive mesh (i.e., an interlocking or intertwining construction arrangement similar to a grid, net or screen) which is substantially transparent at optical frequencies but substantially opaque at an operational frequency (e.g., microwave frequencies).

Although orthogonally-arranged mesh embodiments are illustrated in FIGS. 1–8, the teachings of the invention include any mesh arrangement (e.g., diagonal or non-uniform with variously-shaped open areas) that is substantially transparent at optical frequencies but substantially opaque at a lower operational frequency. That is, any mesh arrangement which is sufficiently transparent (e.g., in the range of 70% and 90%) and whose open areas are sufficiently small so that it appears opaque to operational wavelengths.

Although patch and dipole antenna embodiments of the invention have been illustrated, its teachings can be used to form various other antenna structures. Although planar antenna embodiments have been illustrated, various nonplanar embodiments may also be realized.

Antennas of the invention can be configured for various microwave frequencies and they include embodiments that replace the interconnect cable (e.g., cable 24 in FIG. 1) with an integral connector (for reception of an interconnect cable) and embodiments that integrate the antennas with power amplifiers to form transmitting systems and integrate the antennas with low-noise amplifiers to form receiving systems.

The embodiments of the invention described herein are exemplary and numerous modifications, variations and rearrangements can be readily envisioned by anyone skilled in the art to achieve substantially equivalent results, all of which are intended to be embraced within the spirit and scope of the invention as defined in the appended claims.

I claim:

1. A substantially transparent antenna, comprising:

a substantially transparent substrate having first and second sides;

a first and second conductive films respectively carried on said first and second sides wherein:

a) said first conductive film has a first film area and is shaped to define at least one patch and to define a first array of first open spaces whose areas sum to a first open-spaces area that is at least 70% of said first film area; and b) said second conductive film has a second film area and is shaped to define a around plane and to define a second array of second open spaces whose areas sum to a second open-spaces area that is at least 70% of said second film area.

2. The antenna of claim 1, wherein said substrate comprises a substantially transparent dielectric material selected from at least one of glass, polystyrene, polycarbonate, air, polyester and acrylic.

3. The antenna of claim 1, wherein said substrate comprises acrylic.

4. The antenna of claim 1, wherein said first and second arrays are orthogonal arrays.

5. The antenna of claim 1, wherein said first and second conductive films comprise a metal.

6. The antenna of claim 1, wherein said first and second conductive films comprise a metal selected from at least one of aluminum, copper, gold, silver, tin and nickel.

7. The antenna of claim 1, further including first and second plastic films that each carry a respective one of said first and second conductive films.

8. The antenna of claim 7, wherein said first and second plastic films comprise polyester.

9. The antenna of claim 1, wherein said first conductive film defines a plurality of patches and further including feed lines that serially connect said patches.

10. The antenna of claim 9, wherein said feed lines are defined by a third conductive film having a third film area and shaped to define a third array of third open spaces whose areas sum to a third open-spaces area that is at least 70% of said third film area.

11. The antenna of claim 1, wherein said first conductive defines a plurality of patches and further including a feed line that connects said patches in parallel.

12. The antenna of claim 11, wherein said feed line is defined by a third conductive film having a third film area and shaped to define a third array of third open spaces whose areas sum to a third open-spaces area that is at least 70% of said third film area.

13. The antenna of claim 1, wherein said patch has a substantially rectangular shape.

14. The antenna of claim 1, wherein said patch has a substantially circular shape.

15. The antenna of claim 1, further including a cable having first and second elongate conductors wherein at least one of said conductors is directly coupled to a respective one of said first and second conductive films.

16. The antenna of claim 15, wherein at least one of said first and second conductive films defines a solid area that receives a respective one of said conductors.

17. The antenna of claim 16, further including a cable having first and second elongate conductors wherein at least one of said conductors is capacitively coupled to a respective one of said first and second films.

18. The antenna of claim 1, further including an substantially transparent adhesive between said substrate and said first and second films.

19. The antenna of claim 1, further including at least one suction cup coupled to said substrate for attachment to a support member.

20. The antenna of claim 1, further including an adhesive coupled to said substrate for attachment to a support member.

21. A substantially transparent antenna, comprising:

a substantially transparent substrate having first and second sides;

first and second conductive films respectively carried on said first and second sides wherein:

a) said first conductive film has a first film area and is shaped to define a dipole and to define a first arras of first open spaces whose areas sum to a first open-spaces area that is at least 70% of said first film area, and b) said second conductive film has a second film area and is shaped to define a feed line and to define a second array of second open spaces whose areas sum to a second open-spaces area that is at least 70% of said second film area.

22. The antenna of claim 21, wherein said first and second arrays are orthogonal arrays.

23. The antenna of claim 21, wherein said first and second conductive films comprise a metal selected from at least one of aluminum, copper, gold, silver, tin and nickel.

24. The antenna of claim 21, wherein said substrate comprises a substantially transparent dielectric material selected from at least one of glass, polystyrene, polycarbonate, air, polyester and acrylic.

25. The antenna of claim 21, further including first and second plastic films that each carry a respective one of said first and second conductive films.

26. The antenna of claim 25, wherein said first and second plastic films comprise polyester.

27. The antenna of claim 21, further including a cable having first and second elongate conductors wherein at least one of said conductors is directly coupled to a respective one of said first and second conductive films.

28. The antenna of claim 21, further including a cable having first and second elongate conductors wherein at least one of said conductors is capacitively coupled to a respective one of said first and second films.

* * * * *

UNITED STATES PATENT AND TRADEMARK OFFICE

CERTIFICATE OF CORRECTION

PATENT NO. : 6,933,891 B2
DATED : August 23, 2005
INVENTOR(S) : Mark Lange

It is certified that error appears in the above-identified patent and that said Letters Patent is hereby corrected as shown below:

Column 5,
Line 50, delete “a”.
Line 58, delete “around” and insert -- ground --.

Column 6,
Lines 21-22, insert -- film -- between “conductive” and “defines”.
Line 59, delete “arras” and insert -- array --.

Signed and Sealed this

Sixteenth Day of May, 2006

JON W. DUDAS
*Director of the United States Patent and Trademark Office*